US010927854B2

(12) United States Patent
Olesen et al.

(10) Patent No.: US 10,927,854 B2
(45) Date of Patent: Feb. 23, 2021

(54) ELECTRO-HYDRAULIC WORK VEHICLE WITH ENERGY RECOVERY

(71) Applicants: Danfoss Power Solutions GmbH & Co. OHG, Neumünster (DE); Hyster-Yale Group, Inc., Fairview, OR (US)

(72) Inventors: Casper Mikael Olesen, Sønderborg (DK); Thomas Hansen, Mittelangeln-Dammholm (DE)

(73) Assignee: DANFOSS POWER SOLUTIONS GMBH & CO. OHG, Neumünster (DE)

( * ) Notice: Subject to any disclaimer, the term of this patent is extended or adjusted under 35 U.S.C. 154(b) by 38 days.

(21) Appl. No.: 16/152,547

(22) Filed: Oct. 5, 2018

(65) Prior Publication Data

US 2019/0136874 A1 May 9, 2019

(30) Foreign Application Priority Data

Nov. 9, 2017 (EP) ..... 17200914

(51) Int. Cl.
*F15B 1/02* (2006.01)

(52) U.S. Cl.
CPC ..... *F15B 1/024* (2013.01); *F15B 2211/20569* (2013.01)

(58) Field of Classification Search
CPC ..... F15B 1/024; F15B 2211/20569; E02F 9/2091
See application file for complete search history.

(56) References Cited

U.S. PATENT DOCUMENTS 4,761,954 A * 8/1988 Rosman ..... B66F 9/22 60/372
7,634,911 B2 12/2009 Brinkman
(Continued)

FOREIGN PATENT DOCUMENTS

CN 1987124 A 6/2007
CN 104832464 A 8/2015
(Continued)

*Primary Examiner* — F Daniel Lopez
(74) *Attorney, Agent, or Firm* — McCormick, Paulding & Huber PLLC

(57) ABSTRACT

Electro-hydraulic work vehicle system having a hydraulic lift mechanism comprising a first electric machine, a first hydraulic machine operatively connected to the first electric machine. A load holding valve is switchable between a first position in which it retains pressurized fluid in the hydraulic lift mechanism and a second position in which it enables pressurized fluid to flow between the first hydraulic machine and the hydraulic lift mechanism. A pressure relief valve is switchable between a first, initial position in which it prevents pressurized fluid from flowing from the first hydraulic machine to the hydraulic tank and a second position in which it enables pressurized fluid to flow from the first hydraulic machine to the hydraulic tank. An hydraulic energy storage is hydraulically connected between the first hydraulic machine and the relief valve, wherein in decent mode of hydraulic lift mechanism, the hydraulic system is configured to supply pressurized fluid to the hydraulic energy storage and when the load-holding valve is at its second position and the pressure relief valve is at its first position, wherein pressurized fluid from the hydraulic lift mechanism is capable of driving the first hydraulic machine which can drive the first electric machine to create electricity that can be stored in the electrical energy storage, and/or is capable of charging the hydraulic energy storage.

20 Claims, 5 Drawing Sheets

(56) References Cited

U.S. PATENT DOCUMENTS

| | | | | |
|---|---|---|---|---|
| 7,827,787 | B2 * | 11/2010 | Cherney | E02F 9/2203 60/414 |
| 9,360,023 | B2 * | 6/2016 | Yahner | F15B 21/14 |

FOREIGN PATENT DOCUMENTS

| | | | |
|---|---|---|---|
| CN | 105764764 | A | 7/2016 |
| JP | 2016056808 | A | 4/2016 |
| JP | 6147153 | B2 | 6/2017 |

* cited by examiner

ELECTRO-HYDRAULIC WORK VEHICLE WITH ENERGY RECOVERY

CROSS-REFERENCE TO RELATED APPLICATION

This application claims foreign priority benefits under U.S.C. § 119 to European Patent Application No. 17200914.4 filed on Nov. 9, 2017, the content of which is hereby incorporated by reference in its entirety.

TECHNICAL FIELD

The invention relates generally to a system and method for recovering energy within an electro-hydraulic work vehicle such as a fork lift truck, boom operated work vehicle or the like, in which potential energy from a lifting operation is recovered during the lowering operation and stored for use in further work-function or drive operations within the work vehicle.

BACKGROUND

Work vehicles such as fork lift trucks may comprise of an electrical drive means to drive the vehicle and a hydraulic work function means to provide a means of raising and lowering the forks in the form of an actuator circuit, driving cooling systems and providing other ancillary work functions in order to effectively run an electro-hydraulic vehicle system. It is known to utilize an electric motor/generator to convert energy and therefore create a regenerative braking system wherein the kinetic energy of the vehicle under a braking condition is converted into electrical energy that is used to charge a battery. It is also known to store the hydraulic power on the load that is generated during a lifting operation using hydraulic accumulators, with the pressurised fluid from the accumulators used on demand to assist in load lifting. However, it has been identified that neither make the best use out of the recovered energy, and neither provide an effective use of circuitry to produce the most desirable energy recovery systems.

SUMMARY

It is therefore desirable to capture the energy that is added to the system in terms of potential energy during a lifting operation and store this energy in a form/system that can use, recover and utilise the captured energy hydraulically and electrically during a lowering operation for use in either a drive or work function operation. This is achieved by storing the recovered energy electrically and/or hydraulically for later use in either the hydraulic part of the vehicle system and/or the electrical part of the vehicle system, depending on the demand requirements. The system should be flexible in way of storing recovered energy and capable to adapt the way of energy recovery dynamically based on system and/or operation parameters and/or on operator demands/inputs. Furthermore, the system and method should be designed to be essentially simple in design comprising a low number of valves to improve general efficiency over a conventional hydraulic work function system and to be cost effective in manufacturing of its parts and their assembly to an electro-hydraulic work-vehicle system.

The object according to the invention is achieved by an electro-hydraulic work vehicle system according to the preamble of claim 1, having a hydraulic lift mechanism, a first electric motor/generator and a first hydraulic pump/motor operatively connected to the first electric motor/generator. Wherein the first hydraulic pump/motor is configured to provide pressurized fluid to a hydraulic lift mechanism when driven by the first electric motor/generator. The electro-hydraulic work vehicle further comprise a load-holding valve hydraulically connected in a hydraulic line between the first hydraulic pump/motor and the hydraulic lift mechanism, which is switchable into a first (closed) position in which the load holding valve retains pressurized fluid in the hydraulic lift mechanism, such that the load is held at an elevated level, and which is switchable into a second (open) position in which the load holding valve enables pressurized fluid to flow between the first hydraulic pump/motor and the hydraulic lift mechanism, thereby allowing the load to be lowered. A pressure relief valve is hydraulically connected in a hydraulic line between the first hydraulic pump/motor and a hydraulic tank and is switchable between a first, initial position in which the pressure relief valve prevents pressurized fluid from flowing from the first hydraulic pump/motor to the hydraulic tank and a second position in which the pressure relief valve enables pressurized fluid to flow from the first hydraulic pump/motor to the hydraulic tank. The electro-hydraulic work vehicle is equipped further with an electric energy storage electrically connected to the first electric motor/generator.

The inventive work vehicle is characterized in that a hydraulic energy storage is hydraulically connected in a hydraulic line between the first hydraulic pump/motor and the pressure relief valve, wherein in decent mode of hydraulic lift mechanism, when the load-holding valve is at its second position and the pressure relief valve is at its first position, pressurized fluid from the hydraulic lift mechanism is capable to drive the first hydraulic pump/motor which can drive the first electric motor/generator to create electricity that can be stored in the electrical energy storage, and/or is capable to charge the hydraulic energy storage. Hence, the potential energy of the before lifted load can be recovered and stored either as electric energy in the electric energy storage or as hydraulic energy in the hydraulic energy storage or in both forms, simultaneously. Thereby, according to invention, the hydraulic energy storage is arranged in the hydraulic part of the inventive electro-hydraulic work vehicle system between the hydraulic unit and the tank i.e. upstream of the hydraulic machine when the inventive system operates in energy recovery mode, and downstream of the hydraulic machine when the inventive system operates in working mode. In either mode the hydraulic energy storage is located at the low pressure side of the hydraulic machine. When the hydraulic machine is operated as hydraulic pump the hydraulic energy storage is able to pre-charge the pump's suction side, and when operated as hydraulic motor the hydraulic energy storage is located at the motor's discharge side.

Naturally, it should be understood that the electric motor/generator is an electrical machine operating as a motor when it is powered by the electrical energy storage and operating as a generator if the electrical machine is driven by the hydraulic pump/motor, the same being a hydraulic machine acting as a hydraulic pump when driven by the electric motor and acting as a hydraulic motor when driven by pressurized hydraulic fluid. In the latter mode the hydraulic machine is capable to drive the electric machine which then—as already mentioned above—operates as an electric generator.

In the following the invention is descript by the help of a hydraulic lifting mechanism, however a skilled person detects that the present invention is applicable on all hydraulic hybrid systems which are primarily driven/powered by electric energy and whose functions are at least partly driven hydraulically. In such work vehicles this primary electric energy is frequently converted to hydraulic energy in order to realize work functions, e.g. to enhance stored potential energy, in particular elevation energy of a load in form of pressurized hydraulic fluid. In order to recover at least part of the primary energy brought into the hydraulic part of the inventive work vehicle the first hydraulic pump/motor can be driven by the pressurized hydraulic fluid when the load, i.e. the elevation/potential energy is lowered. Thereby the hydraulic pump/motor can drive the electric motor/generator and/or at the same time, charge the hydraulic energy storage.

In one embodiment of the invention a control unit, it is preferable that an electronic control unit is connected in a suitable way at least to the first electric motor/generator, the first hydraulic pump/motor, the electric energy storage and/or to the hydraulic energy storage for controlling the charging of one or both of the energy storages on demand of the operator, the working conditions, or the system parameters.

When the first hydraulic pump/motor drives the first electric motor/generator, part or all of work vehicles system's potential energy can be recovered/converted by the first electric motor/generator in electric energy and can subsequently be recovered in the electric energy storage. The rate of conversion into electric energy can thereby be adjusted by means of adjusting the displacement of the first hydraulic pump/motor preferably controlled by the electronic control unit. Downstream the first hydraulic pump/motor the (remaining) energy in the pressurized hydraulic fluid leaving the first hydraulic pump/motor can be stored in the hydraulic energy storage, also called hydraulic accumulator.

Depending on the working conditions, the charge level of the electric energy storage, e.g. an electric accumulator or a rechargeable battery, and/or the charge level of the hydraulic energy storage, all the recoverable energy can be used for charging either or both of the electric energy storage or the hydraulic energy storage. In case the hydraulic energy downstream the hydraulic motor should not be recovered, e.g. because of the pressure level in the hydraulic energy storage is higher than the pressure level in the hydraulic fluid downstream the hydraulic motor, the pressure relief valve can be switched into its second position, in which the pressure relief valve enables pressurized fluid to flow from the first hydraulic motor to the tank. In this case a switching value for preventing pressurized fluid flowing from the hydraulic energy storage to tank is provided at the outlet of the hydraulic energy storage. The pressure relief value can be used also as a kind of emergency lowering function of the load, as pressurized hydraulic fluid is dumped then directly into the tank.

Merely to simplify the description of the present invention, a cylinder/piston-unit for lifting and lowering a load was selected, exemplarily as lifting mechanism. A skilled person will detect a plurality of other hydraulic functions/application which fit to the inventive concept and whose potential and/or kinematic energy level can be recovered by the inventive system. In this sense, hydraulic functions exerting a non-constant force on a load, e.g. acting against an elastic force, are also covered by the inventive idea.

According to the invention the potential energy stored in the system can be recovered when lowering/releasing the load by converting the stored energy into electrical energy and charge an electrical energy storage and/or conducting hydraulic energy to store it in the hydraulic energy storage. For this purpose, in a basic embodiment of the invention a load holding valve is used for retaining in a first (closed) position the energy stored in the application, here, e.g. the lifting mechanism. When the potential energy level of the function/application has to be reduced, for instance, when the load has to be lowered, the load holding valve is opened, i.e. switched into a second position, and pressurized hydraulic fluid is enabled to flow towards the hydraulic machine which is then operated as a hydraulic motor. By this means the electric machine can by operated as a generator to produce electric current which can be stored in an electric energy storage, e.g. a rechargeable battery. However, the hydraulic fluid discharged by the hydraulic motor still comprises hydraulic energy which can be stored according to the invention in a hydraulic energy storage. In case this energy should not be directed to the hydraulic energy storage, the hydraulic fluid discharged by the hydraulic motor can be conducted to tank also when the pressure relief valve is switched into its second position.

In an embodiment of the invention the pressure relief valve is also able to fulfil a pressure limiting function for the hydraulic energy storage, as the pressure relief valve can be held pre-stressed, and in its first initial, hydraulic line closing position by means of a valve spring, whose elastic force is traversed when exceeding a certain, predetermined pressure level in the hydraulic line, upstream the pressure relief valve acts upon the pressure relief valve spool in a 'valve' opening direction. This means that the pressure in the hydraulic energy storage can be at maximum as high as the opening pressure of the pressure relief valve allows. Hence, the hydraulic energy storage can be protected of over pressure by selecting an adequate opening pressure for the pressure relief valve. In another embodiment the electronic control unit is also capable of switching the pressure relief valve and to control therewith the charge/pressure level of the hydraulic energy storage, depending on system and operational parameters, e.g. when a predetermined pressure level is reached in the hydraulic energy storage.

In a further embodiment the electronic control unit is capable to control the decent rate of a load by means of adjusting the displacement of the first hydraulic machine, here operating as a hydraulic motor. Thereby it can be thought, for instance, in maintaining the decent rate constant that leads to a continuous adaptation of the displacement of the hydraulic motor to the continuously increasing pressure level in the hydraulic energy storage and the continuously decreasing pressure delta to the pressure in the lift mechanism during lowering/releasing the load. Furthermore, in one embodiment, the electronic control unit can be capable to demand the electric machine in decent mode of the hydraulic function to operate also as a motor in order to drive/support the hydraulic motor in charging the hydraulic energy storage, when e.g., the load is not high enough to obtain a sufficient pressure level in the hydraulic energy storage. The electric machine can also be used to speed-up the decent rate of the load if necessary. This may be the case with loads, as the delta pressure between the pressure in the work function and the pressure in the hydraulic energy storage decreases during lowering the load. Another example is load lifting with a fork lifter and lowering the empty fork without any load. Here a support to raise the decent speed can save handling time and/or help to charge the hydraulic energy storage for the next lifting operation. A skilled person will find here a plurality of other typical applications, for instance for boom operated hydraulic functions. Hence, all of them are covered by the inventive idea.

In a further preferred embodiment of the invention the electro-hydraulic system for a work vehicle further comprises a second electric motor/generator and a second hydraulic pump/motor operatively connected to the second electric motor/generator. The second hydraulic pump/motor is configured to provide pressurized fluid to the first hydraulic pump/motor when driven by the second electric motor/generator. The second electric motor/generator can by energized/powered by the electrical energy storage of the work vehicle and, vice versa, when acting as a generator recover electrical energy into the electrical energy storage. For this purpose the high pressure side of the second hydraulic pump/motor is hydraulically connected to the low pressure side of the first hydraulic pump/motor preferable between the first hydraulic pump/motor and the hydraulic energy storage. In this pre-charge connection line between the first hydraulic pump/motor and the second hydraulic pump/motor a pre-charge valve for opening and closing the pre-charge line between the first and second hydraulic pump/motor is arranged. The low pressure side of the second pump/motor is hydraulically connected to tank.

With this arrangement of the second hydraulic pump/motor and the second electric motor generator the first hydraulic pump/motor can be pre-charged with hydraulic energy when the second electric motor/generator is powered by the electrical energy storage. In the other way round in decent mode of the hydraulic work function hydraulic energy present on the low pressure side of the first hydraulic pump/motor, which should not or cannot be used for charging the hydraulic energy storage, can be conducted to the second hydraulic pump/motor in order to drive the second hydraulic machine (here as a motor) which in turns drives the second electrical machine which operates as a generator, and creates electrical energy that can be stored in the electrical energy storage.

With the embodiment described before a two-stage electric recovery of the potential energy in the lift mechanism can be realized. Furthermore, at the same time, if the pressure on the low pressure side of the first hydraulic machine is high enough the hydraulic energy storage can be charged as well. By doing this a more effective recovering of the potential energy stored in the hydraulic function of the work vehicle is achieved.

In another embodiment of the inventive electro-hydraulic system a high-pressure connection line branches-off of the load holding valve, which is connected to the high-pressure side of the first hydraulic machine between the load-holding valve and the first hydraulic machine. In this high pressure line a lowering control valve is located. This lowering control valve is switchable between a first position in which the lowering control valve prevents the (high) pressurized fluid from flowing from the load-holding valve to the second hydraulic pump/motor, and a second position in which the lowering control valve enables (high) pressurized fluid to flow from the load-holding valve to the second hydraulic pump/motor. The pre-charge-valve in the pre-charge line connecting the high pressure side of the second hydraulic machine with the low pressure side of the first hydraulic machine is switchable between a first position in which the pre-charge valve prevents pressurized fluid from flowing from the second hydraulic pump/motor to the first hydraulic pump/motor and a second position in which the pre-charge valve enables pressurized fluid to flow from the second hydraulic pump/motor to the first hydraulic pump/motor. Hence, the lowering control valve is capable to open and close the high-pressure connection line in order to operate the second hydraulic machine in decent mode as a hydraulic motor which in turns drives the second electric machine which operates as a generator for creating electric energy to be stored in an electrical energy storage, which must not necessarily be the same device or element as for the first electric motor/generator. In this condition the pre-charge valve must be in the first position preventing hydraulic fluid flow to the low-pressure side of the first hydraulic machine.

With this high pressure connecting line a second flow path for pressurized fluid from the hydraulic lifting mechanism to the hydraulic energy storage is provided wherein the load-holding valve is at its second position. Here, the first flow path is leading via the first hydraulic pump/motor to the hydraulic energy storage or to tank when the pressure relief valve is at its second position. The second flow path is going from the load-holding valve via the lowering control valve at its first position to the second hydraulic machine and further to tank. These two flow paths are bi-directional, i.e. they can be used also for driving the lift mechanism, or in general the hydraulic function of the work vehicle, as well as for energy recovery as mentioned before. Furthermore, the high pressure connecting line can also be used for providing hydraulic energy to secondary/auxiliary functions of the work vehicle. Needless to say that secondary/auxiliary functions of the work vehicle can also be powered by hydraulic energy storage, e.g. with the first and second hydraulic machine at neutral setting and the pre-charge valve in open position.

For a person with skills in the relevant art it is clear that all, some or none of the load-holding valve, the lowering control valve, or the pre-charge valve are proportional (directional) control valves. This means that these valves can be two-position valves as well as proportional valves which can be, e.g. controlled by the control unit, opened and closed in controlled manner in order to control the pressure in the correspondent hydraulic lines.

In operation of the inventive-electro-hydraulic system, i.e. when lifting the load, i.e. elevating the potential energy of the system's hydraulic functions there can be distinguished in general between two situations: Sufficient pressurized fluid in the hydraulic energy storage and insufficient pressurized fluid in the hydraulic energy storage for powering the hydraulic function. In the first case for lifting a load or performing another hydraulic function sufficient pressurized fluid from the hydraulic energy storage can be used directly to drive the first hydraulic machine—in working operational mode operating as a hydraulic pump. In the second case when there is insufficient pressurized fluid in the hydraulic energy storage one or both of the first hydraulic pump and the second hydraulic pump has to be driven by the associated connected electric motor, thereby energized by the electric energy storage. Hence, in the first case with sufficient pressurized fluid in the hydraulic energy storage no additional electric energy is necessary to perform the demanded hydraulic function of the electro-hydraulic vehicle.

In the second case, when the hydraulic energy storage is not charged sufficient with pressurized fluid the hydraulic energy is not sufficient to perform the demanded hydraulic function and therefore additional electric energy is necessary to obtain sufficient hydraulic energy to perform a hydraulic function. In principal, according to the invention there are two possibilities: either to drive the first hydraulic pump by means of the first electric motor in order to increase the hydraulic energy on the high pressure side of the first hydraulic pump or to drive by means of the second electric motor the second hydraulic pump in order to raise the hydraulic pressure level at the low pressure side of the first hydraulic pump. The later also leads to an increase of the pressure on the high pressure side of the first hydraulic pump.

As mentioned before the electro-hydraulic system for a work vehicle according to the invention comprises at least one control unit for controlling the different electric and hydraulic machines as well as the positions of the different valves. The control unit is further capable to change the valves positions, e.g. by controlling an actuator's current which is active on the valve spool, for instance. The inventive electro-hydraulic system further comprises at least one sensor to determine load parameters for a load carried by the hydraulic lift mechanism (primary hydraulic function) and/or sensing rotational speeds or decent/lifting speed of this load. The control unit can further be configured to receive the load parameter from the sensor and is programmed to determine a load lowering quality based on the load parameters. Here under load lowering quality different load characteristics are summarized, as the weight, the height of the load level over ground, the lifting/descend speed, the lifting/descend acceleration, the counter force—if any—over the time or any other load related parameter.

As indicated above the controller is capable to adjust the displacement of the two hydraulic machine in order to control the descent rate and is further capable to command the electric machines to operate either as an accelerator—in case of energy recovery—or as electric motor—in case of raising the descent speed—if necessary. Furthermore, the controller is capable to control the electricity generating rate at the first and the second motor/generator in a descent mode of the hydraulic function, which in a single embodiment is a double acting hydraulic cylinder.

DETAILED DESCRIPTION

Figure 1:
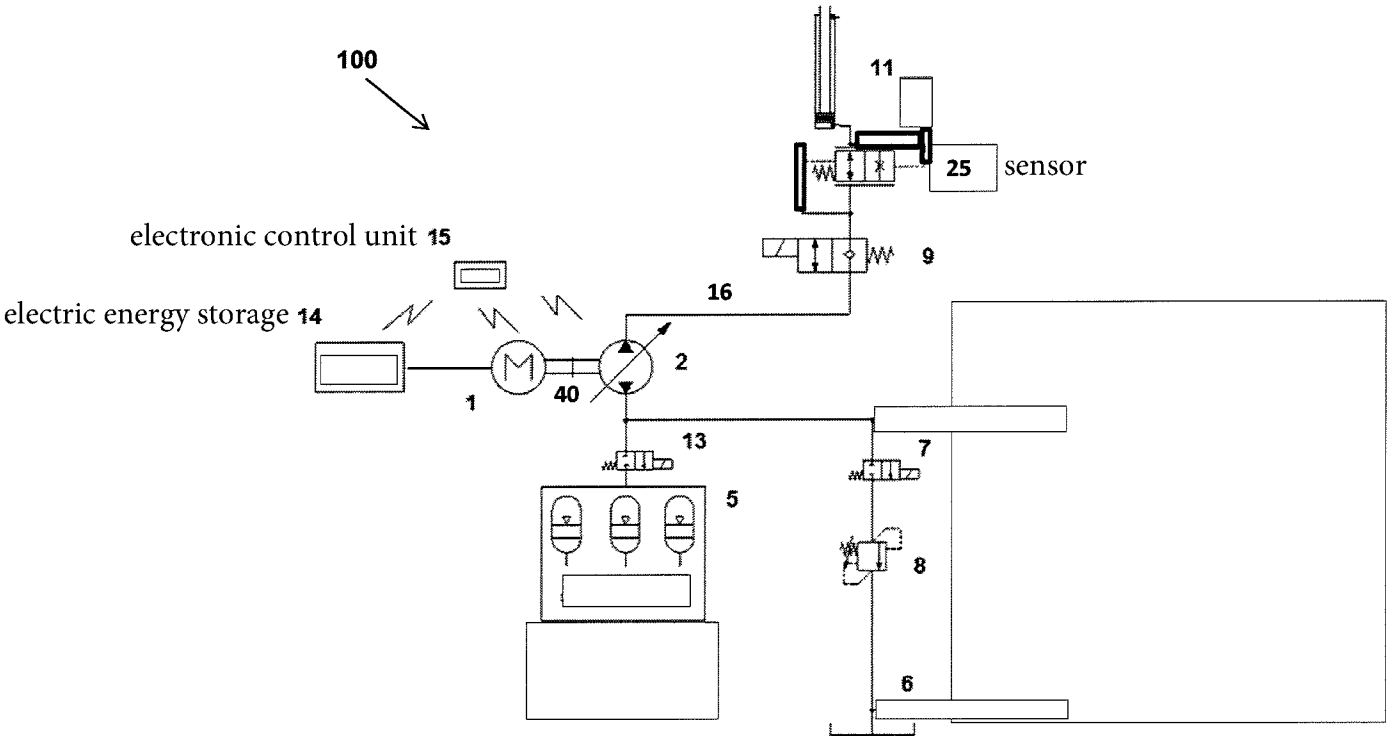
FIG. 1 is a schematic circuit diagram showing a first embodiment of the electro-hydraulic system for a work vehicle according to the invention.

In FIG. 1 a schematic circuit diagram a first embodiment of the electro-hydraulic system 100 according to the invention is shown. The present schematic illustrates that an exemplary hydraulic lift mechanism 11 can be supplied with hydraulic fluid under high pressure by means of a first hydraulic pump/motor 2 in order to lift a load. In the hydraulic line 16 connecting the first hydraulic pump/motor 2 with a hydraulic lift mechanism 11*a* load holding valve 9 is located, which is shown in a first position in which the load holding valve 9 retains the pressure in the hydraulic lift mechanism 11. The load holding valve 9 is switchable into a second position in which pressurized hydraulic fluid is enabled to flow between the first hydraulic pump/motor 2 and the hydraulic lift mechanism 11. The first hydraulic pump/motor 2 can be charged/pre-charged by a hydraulic energy storage 5 arranged at the low pressure side of the first hydraulic pump/motor 2. Thus, when a load has to be lifted by the hydraulic lift mechanism 11, only the delta pressure between the pressure necessary at the high pressure side of the first hydraulic pump/motor 2 to lift the load and the pressure in the hydraulic energy storage 5 has to be provided by a first electric motor/generator 1 operatively connected preferably vie a clutch 40 to the first hydraulic pump/motor 2. Thus the power consumption of primary pump 2 will be reduced compared to systems without hydraulic energy storage 5 at the low pressure side. This power consumption is compensated by an electric energy storage 14 powering the first motor/generator 1. Lifting speed can be controlled thereby by first hydraulic pump/motor 2 and first electric motor/generator 1, which has the function of controlling pump displacement and rotational speed respectively, or can be controlled by a electronic control unit 15 which is capable to control also the electric energy storage 14 and command the position of load holding valve 9. The inventive electro-hydraulic system 100 further comprises at least one sensor 25 to determine load parameters for a load carried by the hydraulic lift mechanism (primary hydraulic function) and/or sensing rotational speeds or descent/lifting speed of this load. The control unit 15 can further be configured to receive the load parameter from the sensor 25 and is programmed to determine a load lowering quality based on the load parameters.

In descent mode pressurized hydraulic fluid flows from the hydraulic lift mechanism 11 via the load holding valve 9 to the first hydraulic pump/motor 2 operating the same as hydraulic motor. Hence with the mechanical output of the first hydraulic motor 2 first electric motor/generator 1 can be driven which generates electric energy that can be stored in the electric energy storage 14. The hydraulic output of the first hydraulic pump/motor 2 can either be stored in the hydraulic energy storage 5 or guided via a pressure relief valve 8 to a tank 6.

Figure 2:
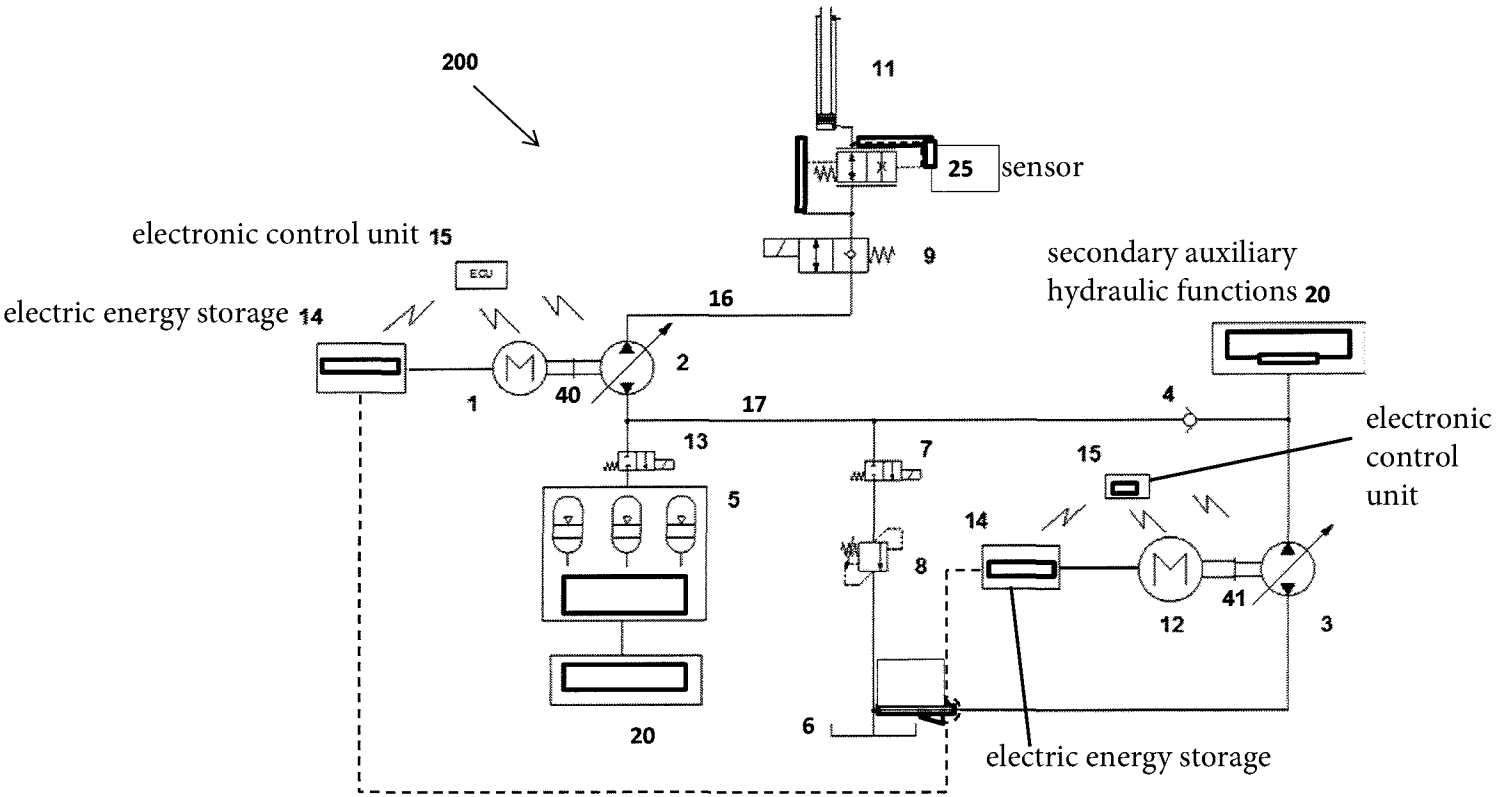
FIG. 2 is a schematic circuit diagram showing another embodiment of the electro-hydraulic system according to the invention.

In FIG. 2 a schematic circuit diagram a further embodiment of the electro-hydraulic system 200 according to the invention is shown. Elements that are the same between the embodiments illustrated in the FIGS. 1 to 5 have the same reference numbers. Here, a pre-charge line 17 is branched-off of the hydraulic connection line connecting the hydraulic energy storage 5 with the first hydraulic pump/motor 2, and leads to a second hydraulic pump/motor 3. In this pre-charge line 17 a pre-charge valve 4, e.g. of the check valve type, is arranged, which opens when the second hydraulic pump/motor 3 is energized to supply pressurized hydraulic fluid to the first hydraulic pump/motor 2. In case the second hydraulic pump/motor 3 has to supply pressurized hydraulic fluid, the same will be driven by a second electric motor/generator 12 being energized by the electric energy storage 14 and operatively also preferably coupled to the second hydraulic pump/motor 3 via a clutch 41. Electronic control unit 15 is also capable of controlling the second electric motor/generator 12 as well as the second hydraulic pump/motor 3.

In case of insufficient pressure present at the hydraulic energy storage 5, the second hydraulic pump/motor 3 can charge the hydraulic energy storage 5 via the pre-charge line 17 and/or provide the first hydraulic pump/motor 2 with pressurized hydraulic fluid. In addition, pressure sensors are integrated in the system to define, e.g., the states of hydraulic energy storage 5 and the load pressure, which will determine in lifting mode the power consumption of the first hydraulic pump/motor 2. Aside from supporting the lifting, the hydraulic energy storage 5 and the secondary pump 3 are able to provide energy into secondary/auxiliary functions 20.

During lowering, depending on the state of vehicle, energy recovery can be achieved by either running the first electric motor/generator 1 as a generator storing electric energy in the electric energy storage 14, charging the hydraulic energy storage 5, or a combination of both of approaches. When hydraulic energy storage 5 is filled up, the lowering energy will drive the first hydraulic pump/motor 2 and motor 1 to generate electricity; the returning flow will be dumped into hydraulic tank 6 when pressure relief valve 8 is in its second position, i.e. in the open position. As long as pressure relief valve 8 is in its first (closed) position the returning flow will be guided towards the hydraulic energy storage 5. Thereby an over-pressure limitation of the hydraulic energy storage 5 can be realized with pressure relief valve 8. Further functions of second hydraulic pump/motor 3 are, compensating leakage in the circuit and maintaining emergency lifting flow. The size and pre-charge pressure of the hydraulic energy storage 5 will determine energy recovery distribution to electric energy storage 14 or (and) to hydraulic energy storage 5.

Figure 3:
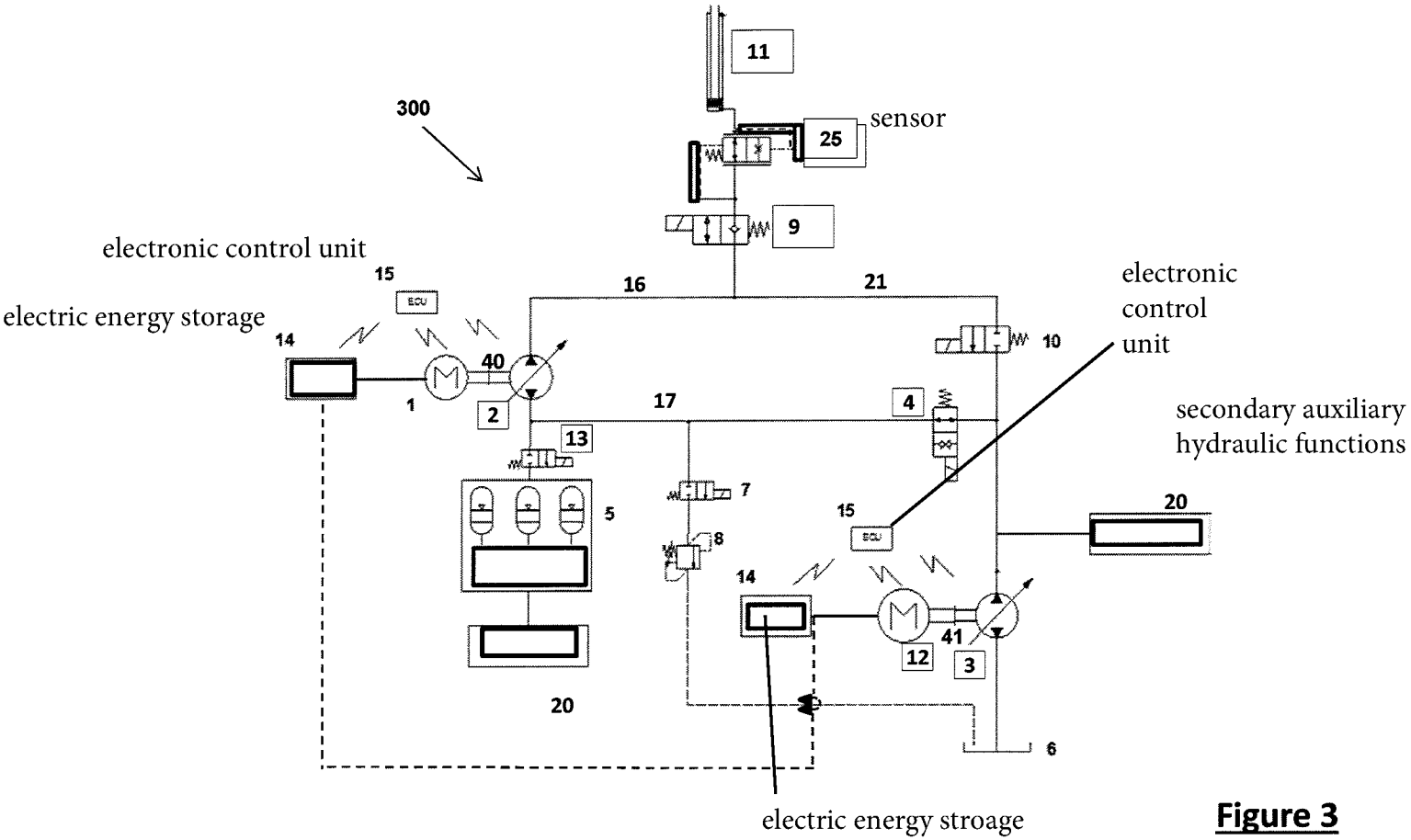
FIG. 3 is a schematic circuit diagram showing an further embodiment of the electro-hydraulic system according to the invention.

FIG. 3 shows a further embodiment of the electro-hydraulic system 300 according to the invention, in which, compared to the embodiment of FIG. 2, a high pressure line 21 branching-off of the pre-charge line 17 between the second hydraulic pump/motor 3 and the pre-charge valve 4, here in form of a switching valve, and leads to the high pressure side of first hydraulic pump/motor 2 connecting the hydraulic line 16 between the first hydraulic pump/motor 3 and load holding valve 9. This high pressure line 21 provides for two flow paths for (high) pressurized fluid from the hydraulic lift mechanism 11 and the load-holding valve 9. A first flow path leads via the first hydraulic pump/motor 2 to the hydraulic energy storage 5 or to the tank 6, and a second flow path leads via the lowering control valve 10 to the second hydraulic pump/motor 3 and ongoing to the tank 6.

For excess lowering flow more than the capacity of the hydraulic energy storage 5 the pre-charge valve 4, for instance controlled by the electronic control unit 15, will close and the excessive lowering flow will go via the second hydraulic pump/motor 3, running the second electric motor/generator 12 as a generator and recovering electric energy, e.g., in the electric energy storage 14.

When the hydraulic energy storage 5 is filled up or excess lowering flow is guided to the second hydraulic pump/motor 3, the lowering energy of the load is capable of driving the first hydraulic pump/motor 2 and the first electric motor/generator 1 as well, in order to generate electricity for storing in the electric energy storage 14, exemplified in the above description and illustrated in the embodiment of FIG. 1; the returning flow will be dumped into the hydraulic tank 6 when the hydraulic energy storage 5 is filled up.

Another possibility is to recover energy during the lowering of the load via the second flow path and the lowering control valve 10. Here, the first hydraulic pump/motor 2 can be driven via the first flow path and, additionally, the second hydraulic pump/motor 3 can be driven via the second flow path, when the pre-charge valve 4 in its first position closing pre-charge line 17. Additionally, returning flow from the first hydraulic pump/motor 2 can charge the hydraulic energy storage 5 or can be dumped into the tank 6, when, e.g., the pressure level in the returning flow is too low to charge the hydraulic energy storage 5.

As can be seen from FIGS. 2 and 3 secondary/auxiliary hydraulic functions 20, such as a fan drive, horizontal fork movement, inclination adjustment, or the like can be driven directly by second hydraulic pump/motor 3 and hydraulic energy storage 5. Thereby the secondary/auxiliary hydraulic functions 20 are preferably connected to the hydraulic energy storage 5 or to the pre-charge line 17 branching-off between the second hydraulic pump/motor 3 and the pre-charge valve 4.

Figure 4:
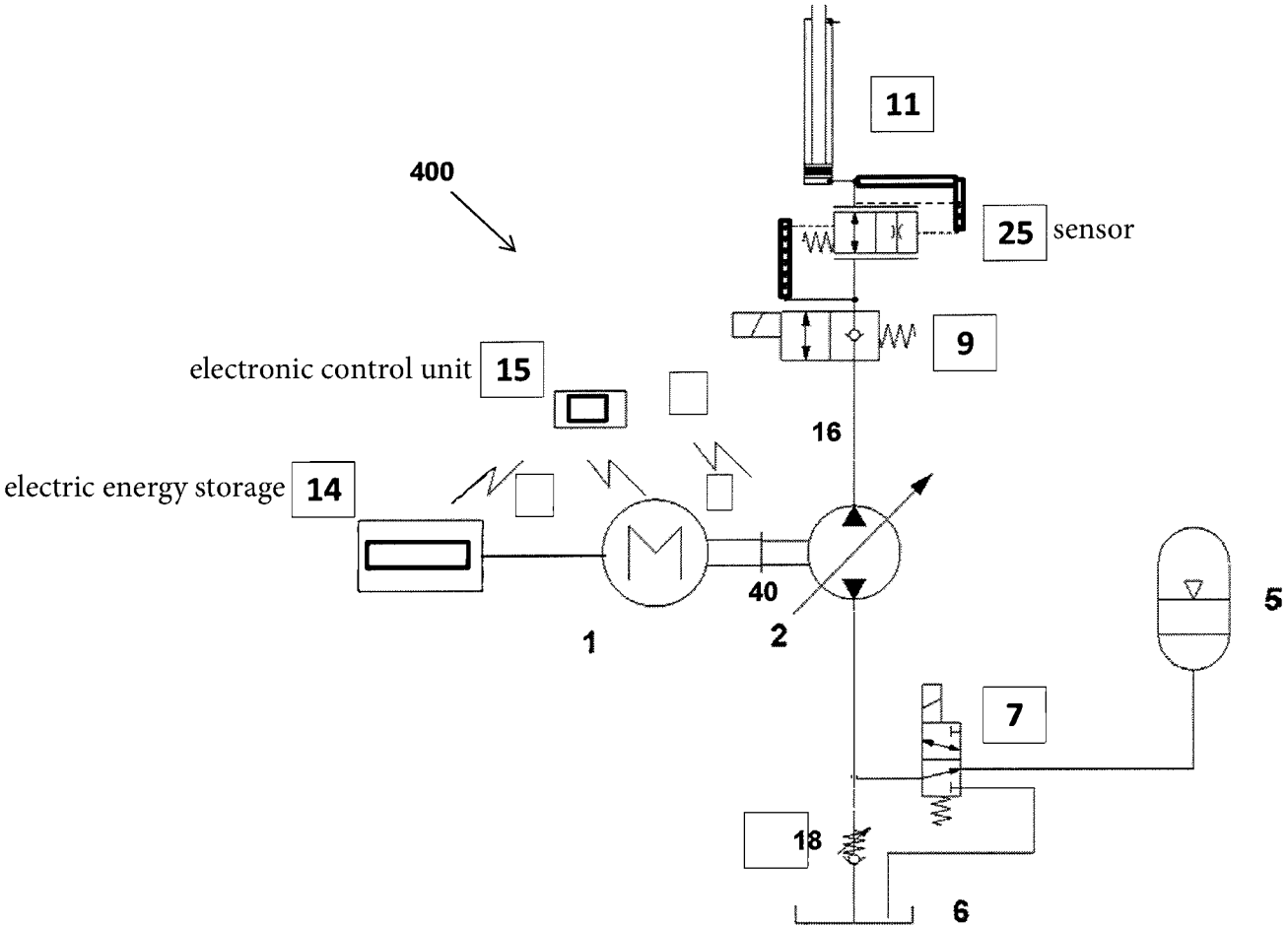
FIG. 4 is a schematic circuit diagram showing an further embodiment of the electro-hydraulic system according to the invention.

FIG. 4 is a further embodiment of the electro-hydraulic system 400 according to the invention which differs from the embodiment of FIG. 1 in that a directional charge control valve 7 is arranged on the low pressure side of the first hydraulic pump/motor 2. In the first, shown position, during lifting process the first hydraulic pump/motor 2 will be charged by hydraulic energy storage 5. Thus, the delta pressure and delta power consumption of primary pump 2 still needed when lifting the load will be reduced, as the pressure in the hydraulic energy storage 5 supports the lifting. When it comes to lifting speed, it is controlled by hydraulic pump 2 and electric motor 1, which have the function of pump displacement and rotational speed control respectively, which in turn can be controlled for instance by electronic control unit 15.

If the energy supply from hydraulic energy storage 5 is not sufficient, first electric motor/generator 1 will supply more driving energy into the first hydraulic pump/motor 2 as and when it is required. During lowering process, first hydraulic pump/motor 2 is turned as hydraulic motor to drive first electric motor/generator 1 to generate electricity, feeding back the electricity to electric energy storage 14. Simultaneously, returning hydraulic fluid flow will be charge to the hydraulic energy storage 5 until the charging pressure of hydraulic energy storage 5 is equal to the load pressure, or reaches its maximum allowable load pressure. At this moment the charge control valve 7 will be switched into the second position, in which it guides returning hydraulic fluid flow to the tank 6. In case the hydraulic pressure in the returning hydraulic fluid flow downstream the first hydraulic pump/motor 2 is lower than the pressure in the hydraulic energy storage 5, however lower than the nominal load pressure, the first electric motor/generator 1 first electric motor/generator 1 will also consume energy to drive hydraulic pump 2 to charge the hydraulic energy storage 5 until load pressure and, if desired, to maintain the desired lowering speed constant, as lowering speed would decrease with increasing pressure in the hydraulic energy storage 5.

Figure 5:
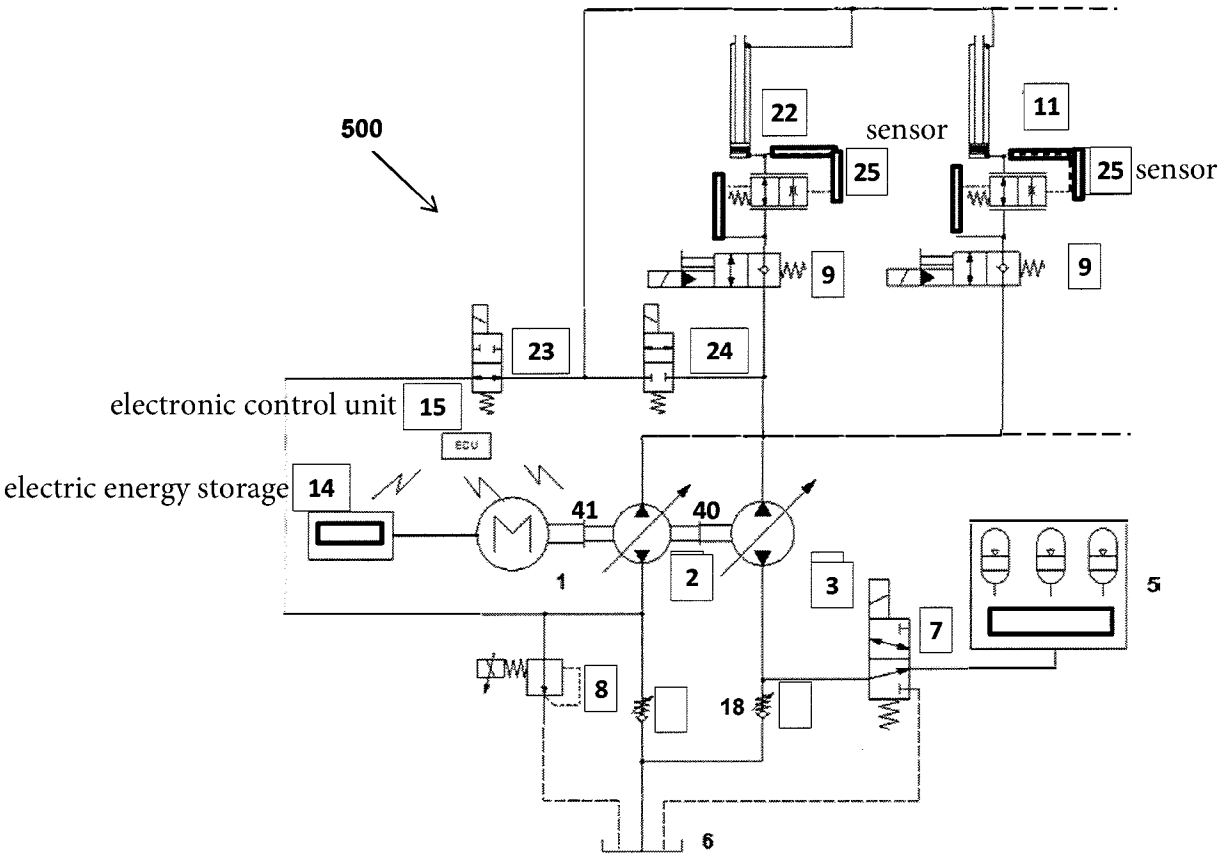
FIG. 5 is a schematic circuit diagram showing an further embodiment of the electro-hydraulic system according to the invention.

FIG. 5 shows a further embodiment of the inventive electro-hydraulic system 500, in which the first hydraulic pump/motor 2 and the second hydraulic pump/motor 3 are operatively connected via clutches 40 and 41 to the first electric motor/generator 1 electrically connected to electric energy storage 14. Wherein during lifting process the second hydraulic pump/motor 3 will be driven by the hydraulic energy storage 5. If the energy supply from hydraulic energy storage 5 is not sufficient, electric motor 1 will supply more energy into the first hydraulic pump/motor 2 and/or second hydraulic pump/motor 3 to satisfy the desired lifting demands. Thereby, like in all other embodiment according to FIGS. 1 to 4, the first hydraulic pumps/motors 2 and 3 are mechanically coupled by means of commonly known couplings 40 to the first electric motor/generator 1 in order to be driveable independently from each other and the first electric motor/generator 1.

Besides, energy regeneration is achieved by opening directional control valve 24, closing directional control valve 23, and oil is pushed from rod chamber directly flowing into piston chamber by which a higher lifting speed is gained. During the lowering process the hydraulic pump/motor 2 is turned as hydraulic motor to drive electric motor/generator 1 to generate electricity feeding back to electric energy storage 14. Hydraulic pump 3 will charge hydraulic energy storage 5 by load pressure. Until the charging pressure of hydraulic energy storage 5 is equal to the load pressure, hydraulic pump/motor 2 partially keep generating energy back to electric energy storage 14 and some part is to utilize charging the hydraulic energy storage 5.

Return flow after crossing hydraulic pump/motor 2 is able to flow back to rod chamber of cylinders 22 or 11. The amount of return flow will be re-used for energy regeneration in the next lifting cycle. When the hydraulic energy storage 5 is filled up, the lowering energy will drive hydraulic pump/motor 2 and 3 to generate electricity; the returning flow will be dumped into hydraulic tank 6.

Beneficial effects of the above systems are described as follows:

1. In the hydraulic system of the electro hydraulic system according to the invention the peak energy recovery is realised as a natural part of the inventive circuit.
2. In the hydraulic system of the electro hydraulic machine the circuit essentially show a low number of valves and in effect this improves efficiency over conventional hydraulic systems.

The embodiment of FIG. 5 shows the possibility of using two hydraulic machines and only one electric machine for the supply of a plurality of hydraulic work functions with pressurized hydraulic fluid. This embodiment according to the invention shows also how hydraulic energy can be recovered not only by charging the hydraulic energy storage 5 connected to the first hydraulic pump/motor 2 and charging the electric energy storage 14 by means of driving/operating the first electric motor/generator 1, since, when a load at one hydraulic work functions 11 or 22 is lowered, how pressurized hydraulic fluid can be conducted by the help of direction control valves 23 and 24 to support the lowering speed and/or the lifting or lowering of another subsequent hydraulic work function. If, for instance, the load at lift mechanism 11 is to be lowered the correspondent load holding valve 9 is switched into its second position and pressurized hydraulic fluid flow is enabled to flow towards the first and second hydraulic pumps/motors 2 and 3. If these remain in neutral position, hydraulic flow over these hydraulic machines is prevented. However opening direction control valve 24 enables hydraulic flow from the piston chamber to the rod chamber of hydraulic lift mechanism 11 and thereby enhancing the lowering speed of the load at hydraulic lift mechanism 11.

As can be seen in FIG. 5 as well, the energy recovering concepts shown in the embodiments of FIGS. 1 to 4 are also implemented in the embodiment of FIG. 5. In particular the charging embodiment for the hydraulic energy storage 5 according to FIG. 4, which a person with skills in the relevant art easily converts to the embodiments shown in the FIGS. 1 to 4.

The foregoing is a detailed description of illustrative embodiments of the invention using specific terms and expressions. Various modifications and additions can be made without departing from the spirit and scope thereof. Therefore, the invention is not limited by the above terms and expressions, and the invention is not limited to the exact construction and operation shown and described. On the contrary, many variations and embodiments are possible and fall within the scope of the invention.

What is claimed is:

1. An electro-hydraulic work vehicle system having a hydraulic lift mechanism, the electro-hydraulic system comprising:

a first electric motor/generator;

a first hydraulic pump/motor operatively connected to the first electric motor/generator, wherein the first hydraulic pump/motor is configured to provide pressurized fluid to the hydraulic lift mechanism when driven by the first electric motor/generator;

a load-holding valve hydraulically connected between the first hydraulic pump/motor and the hydraulic lift mechanism, wherein the load holding valve is switchable between a first position in which the load holding valve retains pressurized fluid in the hydraulic lift mechanism and a second position in which the load holding valve enables pressurized fluid to flow between the first hydraulic pump/motor and the hydraulic lift mechanism;

a pressure relief valve hydraulically connected between the first hydraulic pump/motor and a hydraulic tank, wherein the pressure relief valve is switchable between a first, initial position in which the pressure relief valve prevents pressurized fluid from flowing from the first hydraulic pump/motor to the hydraulic tank and a second position in which the pressure relief valve enables pressurized fluid to flow from the first hydraulic pump/motor to the hydraulic tank; and an electric energy storage electrically connected to the first electric motor/generator;

wherein an hydraulic energy storage is hydraulically connected between the first hydraulic pump/motor and the relief valve, wherein in descent mode of hydraulic lift mechanism, the electro-hydraulic system is configured to supply pressurized fluid to the hydraulic energy storage when the load-holding valve is at its second position and the pressure relief valve is at its first position, wherein pressurized fluid from the hydraulic lift mechanism is capable of driving the first hydraulic pump/motor which can drive the first electric motor/generator to create electricity that can be stored in the electrical energy storage, and/or charging the hydraulic energy storage; and wherein the pressurized fluid that drives the first hydraulic pump/motor for driving the first electric motor/generator is, at least at times, the pressurized fluid that is supplied to the hydraulic energy storage.

2. The electro-hydraulic work vehicle system according to claim 1, further comprising an electronic control unit to control a descent rate of a load by means of adjusting the displacement of the first hydraulic pump/motor.

3. The electro-hydraulic work vehicle system according to claim 2, wherein the first electric motor/generator, in descent mode of hydraulic lift mechanism, is capable to drive the first hydraulic pump/motor, in order to raise the descent rate of the load and/or to enhance the pressure in the hydraulic energy storage when the pressure relief valve is in its first position, or to discharge hydraulic fluid to the tank when the pressure relief valve is in its second position.

4. The electro-hydraulic system according to claim 2, further comprising:

a second electric motor/generator;

a second hydraulic pump/motor operatively connected to the second electric motor/generator;

a lowering control valve hydraulically connected between the load-holding valve and the second hydraulic pump/motor, wherein the lowering control valve is switchable between a first position in which the lowering control valve prevents pressurized fluid from flowing from the load-holding valve to the second hydraulic pump/motor and a second position in which the lowering control valve enables pressurized fluid to flow from the load-holding valve to the second hydraulic pump/motor; and a pre-charge valve hydraulically connected between the second hydraulic pump/motor and the first hydraulic pump/motor, wherein the pre-charge valve is switchable between a first position in which the pre-charge valve prevents pressurized fluid from flowing from the second hydraulic pump/motor to the first hydraulic pump/motor and a second position in which the pre-charge valve enables pressurized fluid to flow from the second hydraulic pump/motor to the first hydraulic pump/motor;

wherein the electro-hydraulic system comprises a first flow path;

wherein the electro-hydraulic system provides for pressurized fluid from the hydraulic lift mechanism to the hydraulic energy storage via the first flow path and the first hydraulic pump/motor when the load holding valve is at its second position, the pressure relief valve is at its first position, and the pre-charge valve is at its first position; and wherein the second hydraulic pump/motor is configured to provide pressurized fluid to the first hydraulic pump/motor when driven by the second electric motor/generator when the pre-charge valve is in the second position.

5. The electro-hydraulic work vehicle system according to claim 2, wherein the electronic control unit is capable to switch the pressure relief valve into the second position when a predetermined pressure level is reached in the hydraulic energy storage.

6. The electro-hydraulic work vehicle system according to claim 5, wherein the first electric motor/generator, in descent mode of hydraulic lift mechanism, is capable to drive the first hydraulic pump/motor, in order to raise the descent rate of the load and/or to enhance the pressure in the hydraulic energy storage when the pressure relief valve is in its first position, or to discharge hydraulic fluid to the tank when the pressure relief valve is in its second position.

7. The electro-hydraulic system according to claim 5, further comprising:

a second electric motor/generator;

a second hydraulic pump/motor operatively connected to the second electric motor/generator;

a lowering control valve hydraulically connected between the load-holding valve and the second hydraulic pump/motor, wherein the lowering control valve is switchable between a first position in which the lowering control valve prevents pressurized fluid from flowing from the load-holding valve to the second hydraulic pump/motor and a second position in which the lowering control valve enables pressurized fluid to flow from the load-holding valve to the second hydraulic pump/motor; and a pre-charge valve hydraulically connected between the second hydraulic pump/motor and the first hydraulic pump/motor, wherein the pre-charge valve is switchable between a first position in which the pre-charge valve prevents pressurized fluid from flowing from the second hydraulic pump/motor to the first hydraulic pump/motor and a second position in which the pre-charge valve enables pressurized fluid to flow from the second hydraulic pump/motor to the first hydraulic pump/motor;

wherein the electro-hydraulic system comprises a first flow path;

wherein the electro-hydraulic system provides for pressurized fluid from the hydraulic lift mechanism to the hydraulic energy storage via the first flow path and the first hydraulic pump/motor when the load holding valve is at its second position, the pressure relief valve is at its first position, and the pre-charge valve is at its first position; and wherein the second hydraulic pump/motor is configured to provide pressurized fluid to the first hydraulic pump/motor when driven by the second electric motor/generator when the pre-charge valve is in the second position.

8. The electro-hydraulic work vehicle system according to claim 1, wherein the first electric motor/generator, in descent mode of hydraulic lift mechanism, is capable to drive the first hydraulic pump/motor, in order to raise a descent rate of the load and/or to enhance the pressure in the hydraulic energy storage when the pressure relief valve is in its first position, or to discharge hydraulic fluid to the tank when the pressure relief valve is in its second position.

9. The electro-hydraulic system according to claim 1, further comprising:

a second electric motor/generator;

a second hydraulic pump/motor operatively connected to the second electric motor/generator;

a lowering control valve hydraulically connected between the load-holding valve and the second hydraulic pump/motor, wherein the lowering control valve is switchable between a first position in which the lowering control valve prevents pressurized fluid from flowing from the load-holding valve to the second hydraulic pump/motor and a second position in which the lowering control valve enables pressurized fluid to flow from the load-holding valve to the second hydraulic pump/motor; and a pre-charge valve hydraulically connected between the second hydraulic pump/motor and the first hydraulic pump/motor, wherein the pre-charge valve is switchable between a first position in which the pre-charge valve prevents pressurized fluid from flowing from the second hydraulic pump/motor to the first hydraulic pump/motor and a second position in which the pre-charge valve enables pressurized fluid to flow from the second hydraulic pump/motor to the first hydraulic pump/motor;

wherein the electro-hydraulic system comprises a first flow path;

wherein the electro-hydraulic system provides for pressurized fluid from the hydraulic lift mechanism to the hydraulic energy storage via the first flow path and the first hydraulic pump/motor when the load holding valve is at its second position, the pressure relief valve is at its first position, and the pre-charge valve is at its first position; and wherein the second hydraulic pump/motor is configured to provide pressurized fluid to the first hydraulic pump/motor when driven by the second electric motor/generator when the pre-charge valve is in the second position.

10. The electro-hydraulic system according to claim 9, wherein switching the pre-charge valve to its second position enables pressurized fluid flow towards the second electric motor/generator to create electricity that is stored in the electrical energy storage, and wherein hydraulic fluid is dumped to the hydraulic tank.

11. The electro-hydraulic system according to claim 9, wherein none of the load-holding valve, lowering control valve, and the pre-charge valve are a proportional control valve.

12. The electro-hydraulic system according to claim 9, wherein the electro-hydraulic system is configured to provide pressurized fluid to the hydraulic lift mechanism when there is insufficient pressurized fluid in the hydraulic energy storage to pre-charge the first pump/motor by switching the load-holding valve into its second position, switching the lowering control valve into its first position, switching the pre-charge valve into its second position, operating the second electric motor/generator to drive the second hydraulic pump/motor to supply pressurized fluid to the first hydraulic pump/motor, and operating the first electric motor/generator to drive the first hydraulic pump/motor to provide pressurized fluid to the hydraulic lift mechanism.

13. The electro-hydraulic system according to claim 9, wherein the hydraulic system is configured to provide pressurized fluid to the hydraulic lift mechanism when there is sufficient pressurized fluid in the hydraulic energy storage to pre-charge the first hydraulic pump/motor by the load-holding valve at its second position, switching the lowering control valve at its first position, switching the pre-charge valve at its first position, and operating the first electric motor/generator to drive the first hydraulic pump/motor to provide pressurized fluid to the hydraulic lift mechanism.

14. The electro-hydraulic system according to claim 9, wherein secondary hydraulic functions can be connected to the electro-hydraulic system between the lowering control valve and the second hydraulic pump/motor and can either be driven by the second hydraulic pump/motor with the lowering control valve at its first position or by pressurized fluid from the hydraulic lift mechanism when the load is lowered while the lowering control valve is at its second position.

15. The electro-hydraulic system according to claim 1, further comprising:

a sensor configured to determine a load parameter for a load carried by the hydraulic lift mechanism; and a controller operatively connected to the sensor, the controller configured to receive the load parameter from the sensor and programmed to determine a load lowering quality based on the load parameter;

wherein the controller is configured to raise the descent rate of a load from a current descent rate of the load when the controller determines that a load lowering quality indicates one-half, or less, of maximum lowering performance.

16. The electro-hydraulic system according to claim 15, wherein the descent rate of the load is controlled by the controller modifying the rate at which electricity is generated by the first electric motor/generator.

17. The electro-hydraulic system according to claim 15, wherein the controller is configured to lower the descent rate of a load from the current descent rate of the load when the controller determines that a load lowering quality indicates greater than one-half of maximum lowering performance.

18. The electro-hydraulic system according to claim 15, wherein the descent rate of the load is controlled by (a) the controller modifying the rate at which electricity is generated by the first electric motor/generator, and/or (b) the controller modifying the rate at which electricity is generated by a second electric motor/generator.

19. The electro-hydraulic system according to claim 1, wherein the hydraulic lift mechanism is a double acting hydraulic cylinder.

20. The electro-hydraulic system according to claim 1, wherein secondary hydraulic functions can be powered directly by the hydraulic energy storage.

* * * * *